US007108251B2

(12) United States Patent
Mueller

(10) Patent No.: US 7,108,251 B2
(45) Date of Patent: Sep. 19, 2006

(54) FUEL ENRICHMENT SYSTEM FOR CARBURETORS FOR INTERNAL COMBUSTION ENGINES

(75) Inventor: Gregory L. Mueller, Manitowoc, WI (US)

(73) Assignee: Kohler Company, Kohler, WI (US)

( * ) Notice: Subject to any disclaimer, the term of this patent is extended or adjusted under 35 U.S.C. 154(b) by 200 days.

(21) Appl. No.: 10/774,094

(22) Filed: Feb. 6, 2004

(65) Prior Publication Data

US 2005/0173815 A1 Aug. 11, 2005

(51) Int. Cl.
*F02M 5/08* (2006.01)

(52) U.S. Cl. ..... 261/64.1; 261/64.4; 261/DIG. 67

(58) Field of Classification Search ..... 261/64.1, 261/64.4, DIG. 1, DIG. 8, DIG. 67; 123/436
See application file for complete search history.

(56) References Cited

U.S. PATENT DOCUMENTS 1,749,873 A 3/1930 Cousino
1,870,411 A 8/1932 Horscroft
2,796,242 A * 6/1957 Sarto ..... 261/34.2
2,839,154 A * 6/1958 Sterner ..... 96/256
2,957,683 A * 10/1960 Eberhardt ..... 261/41.1
3,368,326 A * 2/1968 Hervert ..... 96/109
3,548,797 A * 12/1970 Hagihara et al. ..... 123/519
3,685,502 A 8/1972 Oberdorfer, Jr.
3,698,367 A 10/1972 Goodwin
4,254,064 A * 3/1981 Bernauer et al. ..... 261/64.6
4,346,682 A 8/1982 Mader
4,377,146 A * 3/1983 Oniki et al. ..... 123/520
4,429,676 A 2/1984 Gotoh et al.
4,480,618 A 11/1984 Kamifuji et al.

(Continued)

FOREIGN PATENT DOCUMENTS

JP 55-156233 * 12/1980 ..... 261/DIG. 67

(Continued)

OTHER PUBLICATIONS

Information Regarding Choke Plate Enrichment System and Primer Bulb Fuel Enrichment System (1 page), undated.

*Primary Examiner*—Richard L. Chiesa
(74) *Attorney, Agent, or Firm*—Quarles & Brady LLP

(57) ABSTRACT

A carburetor for an internal combustion engine having a body that fastens at a first end to an air filter and at a second end to the intake port of a cylinder head. The body has an intake bore formed in the first end that receives air from the air filter, a throttle bore formed in the second end that provides a fuel/air mixture to the intake port, and a venturi formed between the intake bore and the throttle bore that receives air from the intake bore, provides fuel to form a fuel/air mixture, and provides the fuel/air mixture to the throttle bore. A bore is formed in the body from the venturi and receives a nozzle that communicates fuel to the venturi. A fuel enrichment system, which is responsive to the vibration of the engine, has a passage that communicates air from the intake bore, through the passage, to the nozzle. A valve seat is disposed within the passage and also has a passage to allow the flow of air therethrough. A ball is disposed within the passage of the fuel enrichment system that seats against the valve seat when the engine is below engine cranking speeds to prevent the passage of air through the valve seat. When the engine is above engine cranking speeds, the ball will resonate within the passage of the fuel enrichment system and unseat from the valve seat, thereby allowing the flow of air around the ball and through the valve seat.

16 Claims, 8 Drawing Sheets

U.S. PATENT DOCUMENTS

| | | | | | |
|---|---|---|---|---|---|
| 4,542,723 | A | | 9/1985 | Fujimoto | |
| 4,765,300 | A | | 8/1988 | Fujimura et al. | |
| 5,052,359 | A | | 10/1991 | Hardwick et al. | |
| 5,133,905 | A | * | 7/1992 | Woody et al. | 261/35 |
| 5,273,008 | A | * | 12/1993 | Ditter | 123/179.11 |
| 5,309,875 | A | * | 5/1994 | Gault | 123/179.16 |
| 6,186,117 | B1 | | 2/2001 | Matte | |
| 6,561,495 | B1 | * | 5/2003 | Woody | 261/37 |

FOREIGN PATENT DOCUMENTS

| | | |
|---|---|---|
| JP | 580 53 663 | 3/1983 |

* cited by examiner

FUEL ENRICHMENT SYSTEM FOR CARBURETORS FOR INTERNAL COMBUSTION ENGINES

FIELD OF THE INVENTION

The present invention relates to internal combustion engines. In particular, the present invention relates to fuel enrichment systems for carburetors for internal combustion engines.

BACKGROUND OF THE INVENTION

Internal combustion engines require a higher proportion of fuel in the fuel/air mixture produced in the carburetor (enrichment) during engine start-up cranking speeds to provide easier starting of the engine. Currently, in standard internal combustion engines there are two primary methods of providing the correct fuel enrichment during start-up.

The first method is by the manual or electrical activation of a choke plate. The choke plate is located within the intake bore of the carburetor and can be opened or closed to allow the desired amount of air to flow into the intake bore. When opened, the choke plate completely opens the intake bore and allows the air to flow therethrough. When closed, the choke plate blocks the intake bore except for holes in the choke plate, which have sufficient area to allow a predetermined amount of air to flow into the intake bore to create proper enrichment for start-up.

One drawback to this method of fuel enrichment is that it requires operator interaction. If an engine is difficult to start, the operator must close the choke plate completely to properly enrich the engine for startup. If the choke plate is not completely closed there may not be enough fuel provided to the carburetor and the engine will continue to be difficult to start. In addition, once the engine is running, the operator must remember to open the choke plate or the engine will continue to run in the enriched condition which leads to rough running. A second drawback to this method of fuel enrichment is that it can also be prone to over enrichment, such as if the some or all of the holes in the choke plate become blocked, or under enrichment, such as if the choke plate is not completely closed. Over enrichment can cause hard starting and/or plug fouling.

The second method is by manual or electrical activation of a primer bulb. The primer bulb is typically integral to the carburetor body or remotely mounted to the engine assembly. When the primer bulb is pumped, air or fuel pressure is forced into the fuel circuit pushing the fuel into the carburetor throttle bore.

However, each of these methods have their own particular drawbacks. The first main drawback with the old methods of fuel enrichment is that operator interaction is required. When manually activated both of the above methods can result in not enough fuel being provided to the carburetor and therefore cause difficulty in start-up. The second main drawback is that both of the above methods are prone to over enrichment causing hard starting and/or plug fouling or under enrichment. Both of which prevent easy starting of the engine.

It would therefore be advantageous if a fuel enrichment system for a carburetor of an internal combustion engine could be designed that does not require operator interaction and avoids the problem of over or under enrichment.

SUMMARY OF THE INVENTION

One aspect of the present invention is a carburetor for an internal combustion engine having a body. A first end of the body fastens to an air filter and a second end of the body fastens to an intake port of a cylinder head. An intake bore is formed in the first end and a throttle bore is formed in the second end. A venturi is formed between and interconnects the intake bore and the throttle bore. A bore extends from the venturi through the body to provide fuel to the venturi. A fuel bowl has walls that define an internal volume and is fastened to the body. A fuel enrichment system is responsive to the vibration of the engine and has a passage that is formed in the body. The passage has an inlet that communicates with the intake bore and an outlet that communicates with the bore. The fuel enrichment system prevents the flow of air through the passage when the engine is at speeds less than idle speed and allows the flow of air through the passage when the engine is at speeds greater than cranking speed.

This provides the correct fuel enrichment during engine start-up without operator intervention, prevents the problems of over or under enrichment by providing for a predetermined fuel/air mixture during startup, and allows quick and easy engine starting.

DETAILED DESCRIPTION OF THE PREFERRED EMBODIMENT

Figure 1:
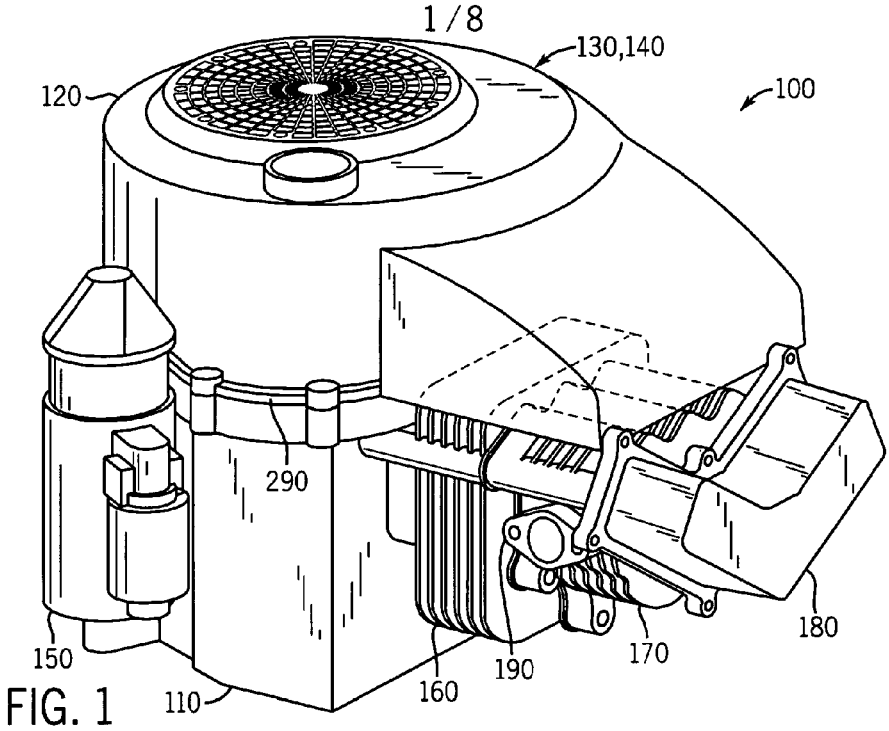
FIG. 1 is a first perspective view of a single cylinder engine, taken from a side of the engine on which are located a starter and cylinder head.
Figure 2:
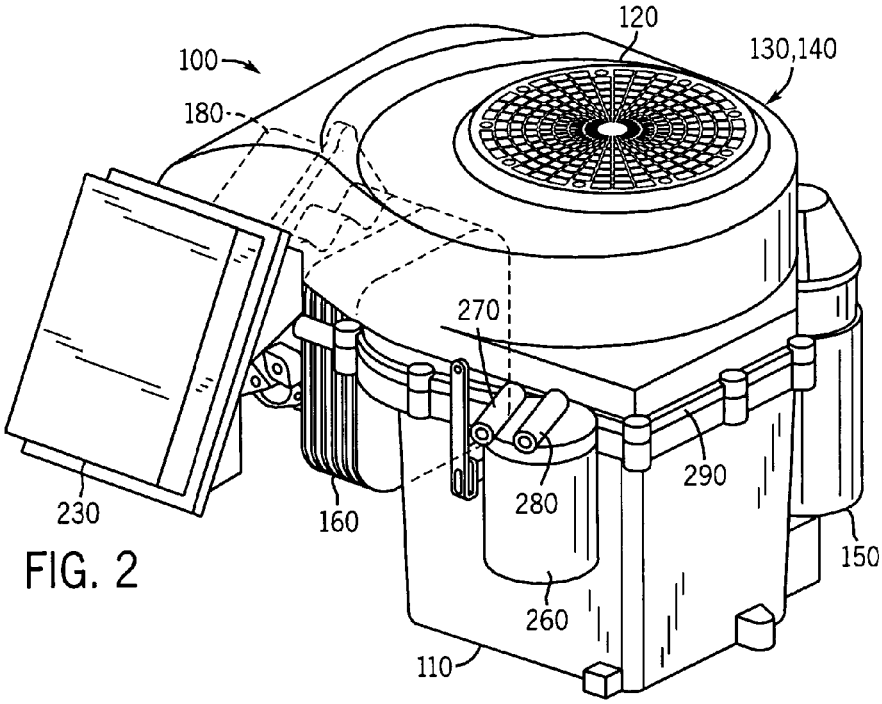
FIG. 2 is a second perspective view of the single cylinder engine of FIG. 1, taken from a side of the engine on which are located an air cleaner and oil filter.

Referring to FIGS. 1 and 2, a single cylinder, 4-stroke, internal combustion engine 100 designed by Kohler Co. of Kohler, Wis. includes a crankcase 110 having a cylinder 160 formed in a sidewall of the crankcase 110, a cover 290 fastened to the top of the crankcase 110, and a blower housing 120 mounted on top of the cover 290. Inside of the blower housing 120 are a fan 130 and a flywheel 140. The engine 100 further includes a starter 150 mounted to the cover 290 and a cylinder head 170, which has a proximal end fastened to the crankcase 110 and extends laterally outward from the sidewall of the crankcase 110 to terminate at a distal end. A rocker arm cover 180 is fastened to the distal end of the cylinder head 170 and defines a cavity therein which forms a valve box, which houses the valves and other components of the valve train, which are discussed in more detail below. Attached to the cylinder head 170 are an exhaust port 190 shown in FIG. 1 and an intake port 200 shown in FIG. 3.

As is well known in the art, during operation of the engine 100, a piston 210 (see FIG. 7) moves back and forth within the cylinder 160 towards and away from the cylinder head 170. The movement of the piston 210 in turn causes rotation of a crankshaft 220 (see FIG. 7), as well as rotation of the fan 130 and the flywheel 140, which are coupled to the crankshaft 220. The rotation of the fan 130 cools the engine, and the rotation of the flywheel 140, causes a relatively constant rotational momentum to be maintained.

Referring specifically to FIG. 2, the engine 100 further includes a carburetor 600, coupled to the intake port 200, and an air filter 230 coupled to the carburetor 600, as described in more detail below. The air filter 230 filters the air required by the engine prior to the providing of the air to the carburetor 600. Air from the air filter 230 is mixed with fuel within the carburetor 600 to create an fuel/air mixture that is then provided from the carbuetor 600 to the intake port 200. The air/fuel mixture provided to the intake port 200 is communicated into the cylinder 160 by way of the cylinder head 170, and the exhaust from the cylinder 160 exits the engine by flowing from the cylinder 160 through the cylinder head 170 and then out of the exhaust port 190. The inflow of the air/fuel mixture and outflow of the exhaust is governed by an input valve 240 and an output valve 250, respectively (see FIG. 8). Also as shown in FIG. 2, the engine 100 includes an oil filter 260 mounted to the cover 290, opposite the starter 150, through which the oil of the engine 100 is passed and filtered. Specifically, the oil filter 260 is coupled to the crankcase 110 by way of incoming and outgoing lines 270, 280, respectively, whereby pressurized oil is provided into the oil filter 260 and then is returned from the oil filter 260 to the crankcase 110.

Figure 3:
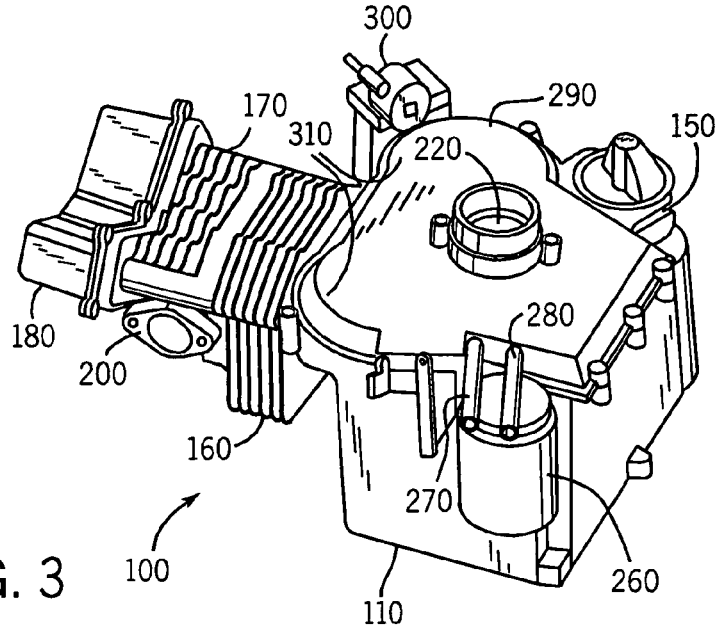
FIG. 3 is a third perspective view of the single cylinder engine of FIG. 1, in which certain parts of the engine have been removed to reveal additional internal parts of the engine.
Figure 4:
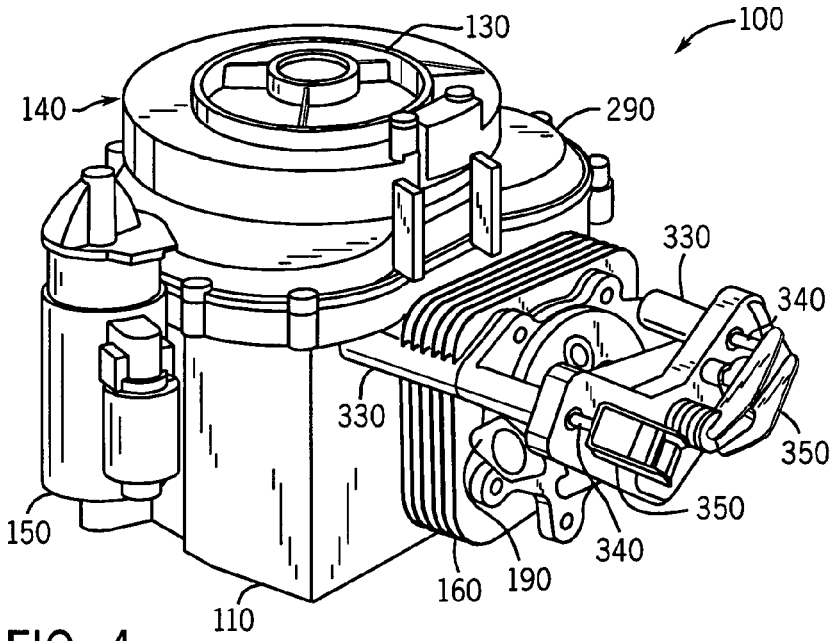
FIG. 4 is a fourth perspective view of the single cylinder engine of FIG. 1, in which certain parts of the engine have been removed to reveal additional internal parts of the engine.

Referring to FIGS. 3 and 4, the engine 100 is shown with the blower housing 120 removed to expose the cover 290 of the crankcase 110. With respect to FIG. 3, in which both the fan 130 and the flywheel 140 are also removed, a coil 300 is shown that is mounted to the cover 290 and generates an electric current based upon rotation of the fan 130 and/or the flywheel 140, which together operate as a magneto. Additionally, the cover 290 of the crankcase 110 is shown to have a pair of lobes 310 that cover a pair of gears 320 (see FIGS. 5 and 7–8). With respect to FIG. 4, the fan 130 and the flywheel 140 are shown above the cover 290 of the crankcase 110. Additionally, FIG. 4 shows the engine 100 without the cylinder head 170 and without the rocker arm cover 180, to more clearly reveal a pair of tubes 330 through which extend a pair of respective push rods 340. The push rods 340 extend between a pair of respective rocker arms 350 and a pair of cams 360 (see FIG. 8) within the crankcase 110, as discussed further below.

Figure 5:
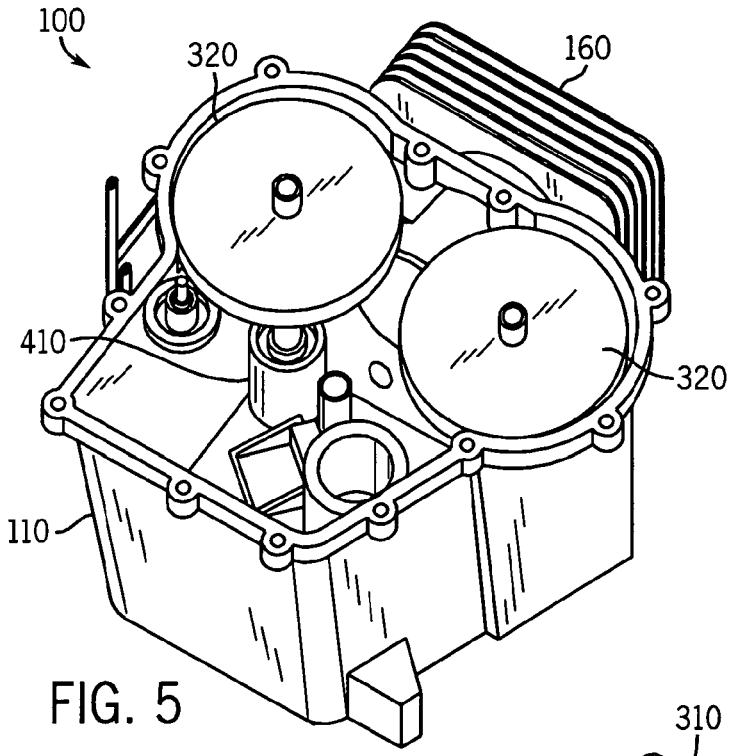
FIG. 5 is fifth perspective view of portions of the single cylinder engine of FIG. 1, in which a top of the crankcase has been removed to reveal an interior of the crankcase.
Figure 6:
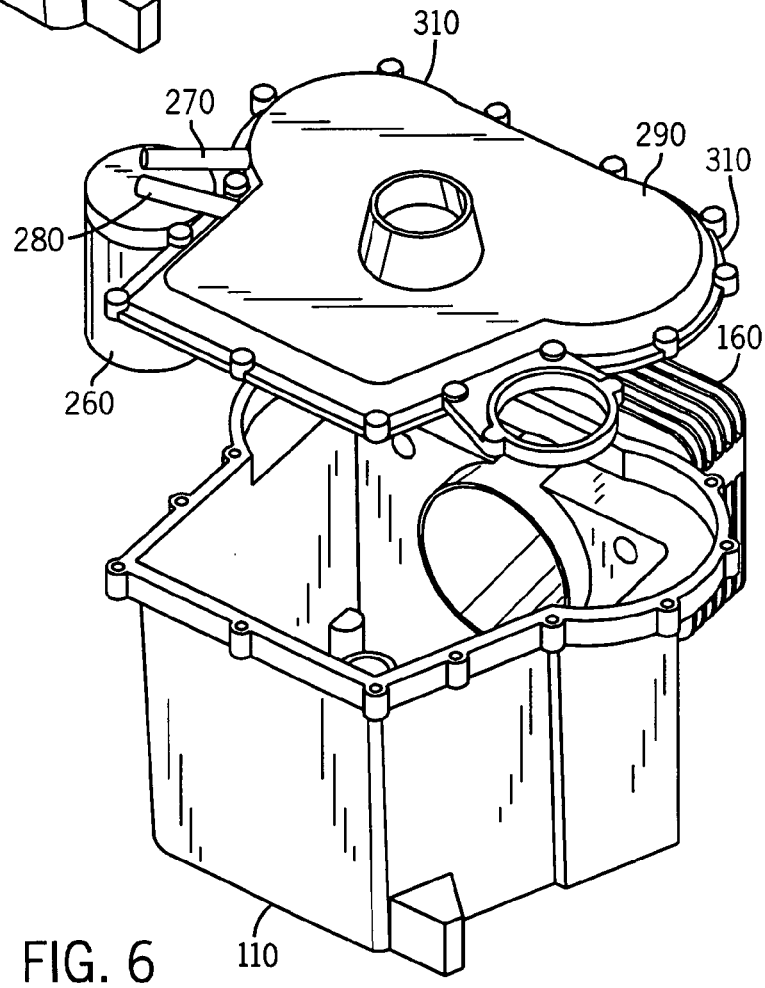
FIG. 6 is a sixth perspective view of portions of the single cylinder engine of FIG. 1, in which the top of the crankcase is shown exploded from the bottom of the crankcase.

Turning to FIGS. 5 and 6, the engine 100 is shown with the cover 290 removed from the crankcase 110 and is shown in cut-away to exclude portions of the engine that extend beyond the cylinder 160 such as the cylinder head 170. With respect to FIG. 6, the cover 290 of the crankcase 110 is shown above the crankcase 110 in an exploded view. The cover 290 and crankcase 110 are manufactured as two separate pieces such that, in order to access the crankcase 110, one physically removes the cover 290 from the crankcase 110. Also, as shown in FIG. 5, the pair of gears 320 within the crankcase 110 are supported by and rotate upon respective shafts 410, which in turn are supported by the crankcase 110.

Figure 7:
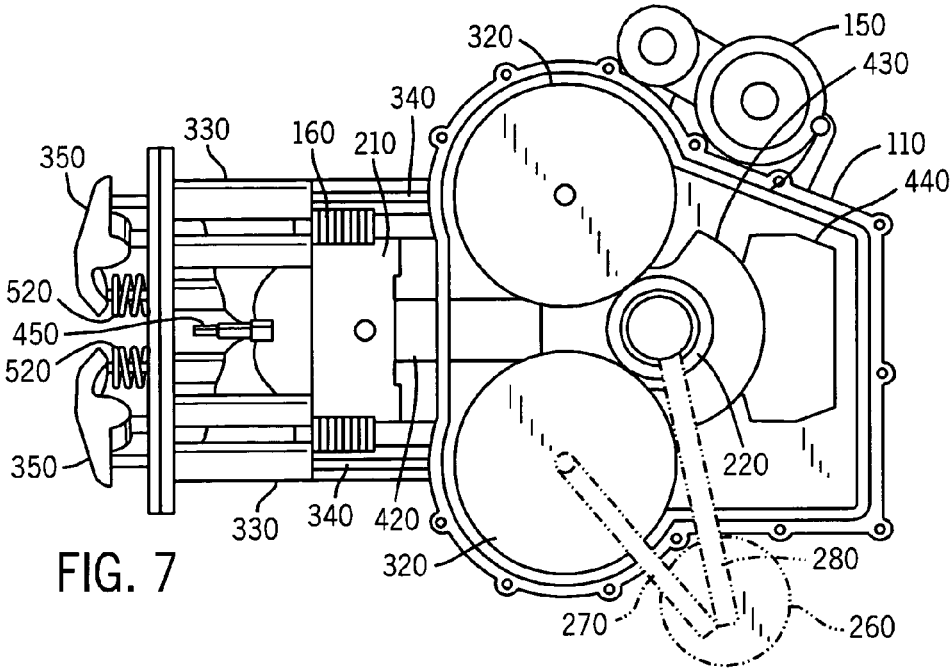
FIG. 7 is a top view of the single cylinder engine of FIG. 1, showing internal components of the engine in grayscale.

Referring to FIG. 7, a top view of the engine 100 is provided in which additional internal components of the engine are shown in grayscale. In particular, FIG. 7 shows the piston 210 within the cylinder 160 to be coupled to the crankshaft 220 by a connecting rod 420. The crankshaft 220 is in turn coupled to a rotating counterweight 430 and reciprocal weights 440, which balance the forces exerted upon the crankshaft 220 by the piston 210. The crankshaft 220 further is in contact with each of the gears 320, and thus communicates rotational motion to the gears. In the present embodiment, the shafts 410 upon which the gears 320 are supported are capable of communicating oil from the bottom of the crankcase 110 upward to the gears 320. The incoming line 270 to the oil filter 260 is coupled to one of the shafts 410 to receive oil, while the outgoing line 280 from the oil filter is coupled to the crankshaft 220 to provide lubrication thereto. FIG. 7 further shows a spark plug 450 located on the cylinder head 170, which provides sparks during power strokes of the engine to cause combustion to occur within the cylinder 160. The electrical energy for the spark plug 450 is provided by the coil 300 (see FIG. 3).

Figure 8:
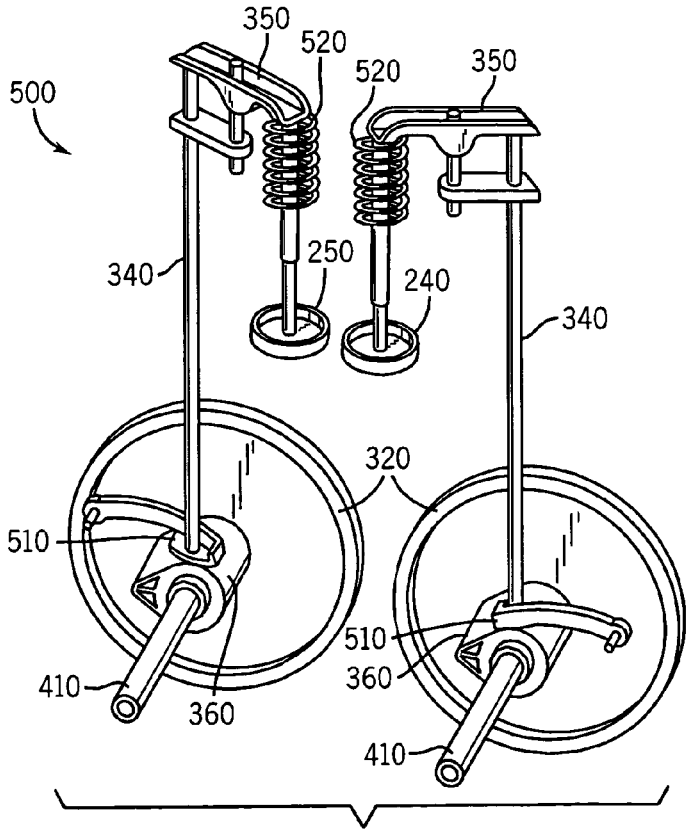
FIG. 8 is a perspective view of components of a valve train of the single cylinder engine of FIG. 1.

Further referring to FIG. 7, and additionally to FIG. 8, elements of a valve train 500 of the engine 100 are shown. The valve train 500 includes the gears 320 resting upon the shafts 410 and also includes the cams 360 underneath the gears, respectively. Additionally, respective cam follower arms 510 are rotatably mounted to the crankcase 110 and extend to rest upon the respective cams 360. The respective push rods 340 in turn rest upon the respective cam follower arms 510. As the cams 360 rotate, the push rods 340 are temporarily forced outward away from the crankcase 110 by the cam follower arms 510. This causes the rocker arms 350 to rock or rotate, and consequently causes the respective valves 240 and 250 to open toward the crankcase 110. As the cams continue to rotate, however, the push rods 340 are allowed by the cam follower arms 510 to return inward to their original positions. A pair of springs 520 positioned between the cylinder head 170 and the rocker arms 350 provide force tending to rock the rocker arms in directions tending to close the valves 240, 250, respectively. Further as a result of this forcing action of the springs 520 upon the rocker arms 350, the push rods 340 are forced back to their original positions.

Referring to FIGS. 9–12, the carburetor 600 of the internal combustion engine 100 is shown. The carburetor has a body 610 that forms the main structure of the carburetor 600. The body 610 has a first end 612, which engages and is fastened to the air filter 230, and a second end 614, which engages and is fastened to the intake port 200.

Figure 9:
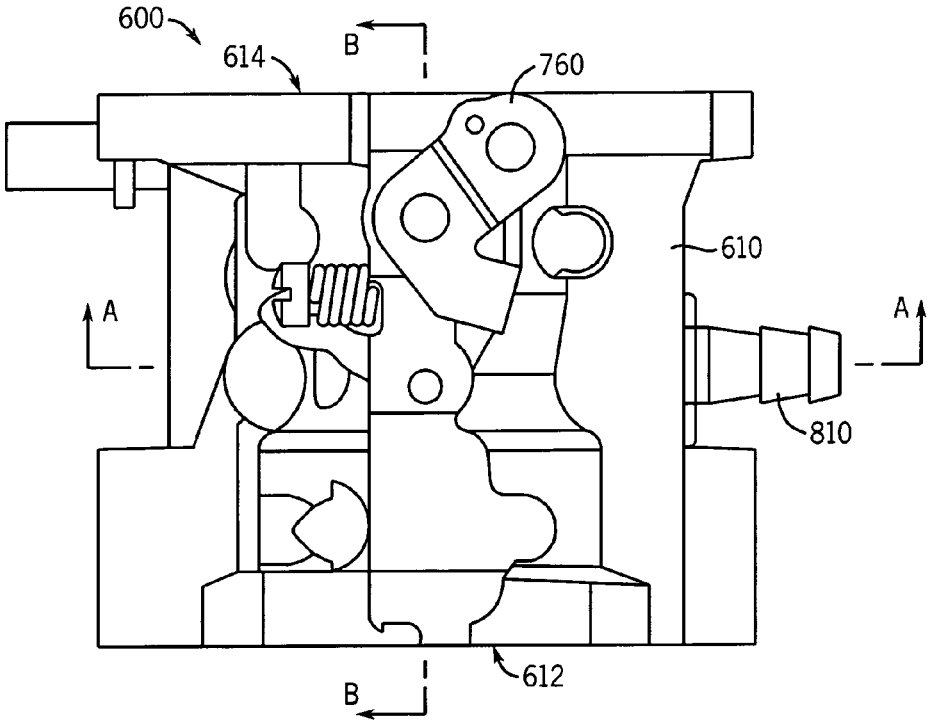
FIG. 9 is top view of the carburetor of the single cylinder engine of FIG. 1.
Figure 10:
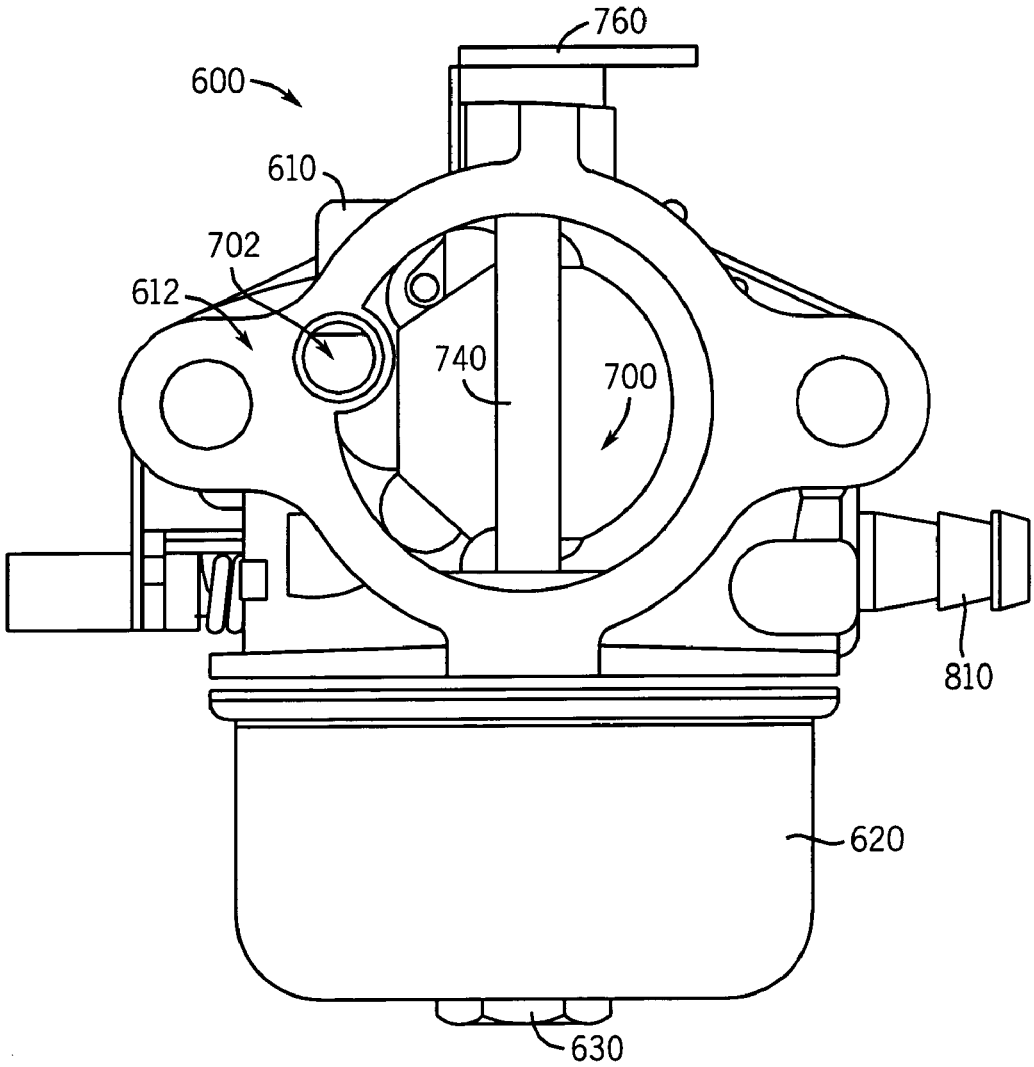
FIG. 10 is a front view of the carburetor of the single cylinder engine of FIG. 1.
Figure 11:
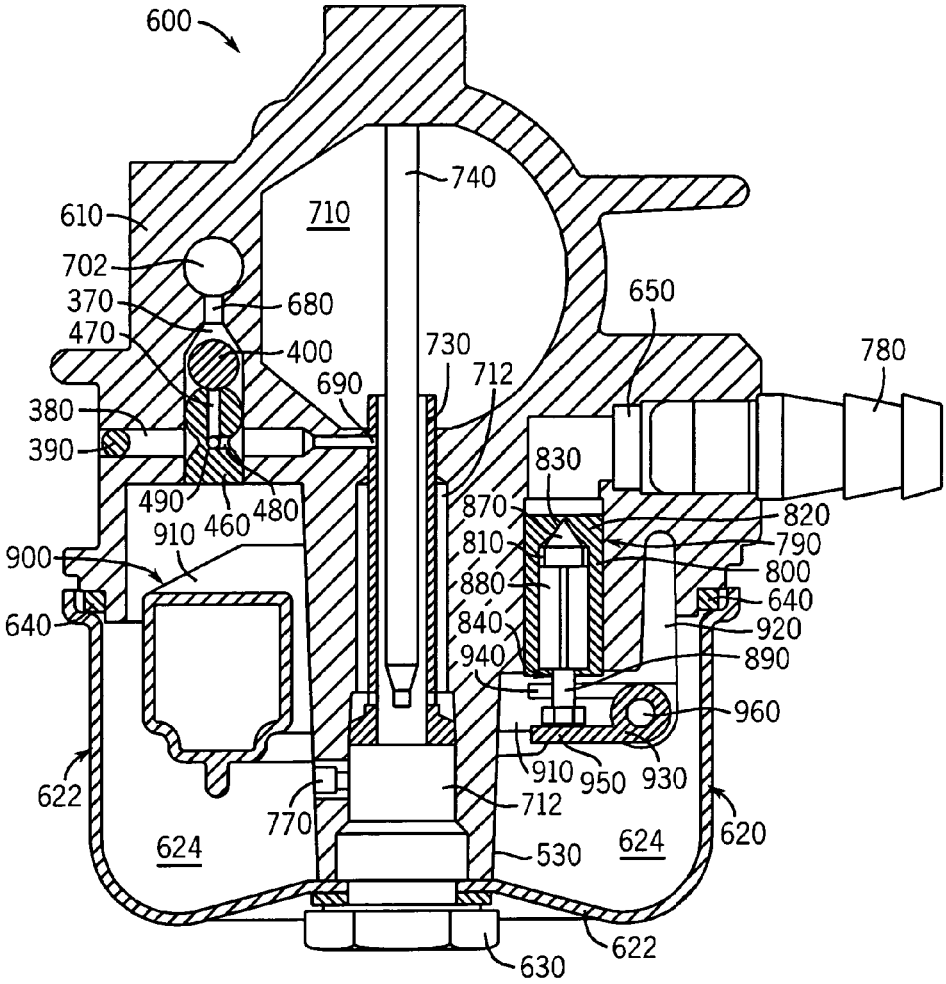
FIG. 11 is a cross sectional view of the carburetor of FIG. 9 taken along line A—A.
Figure 12:
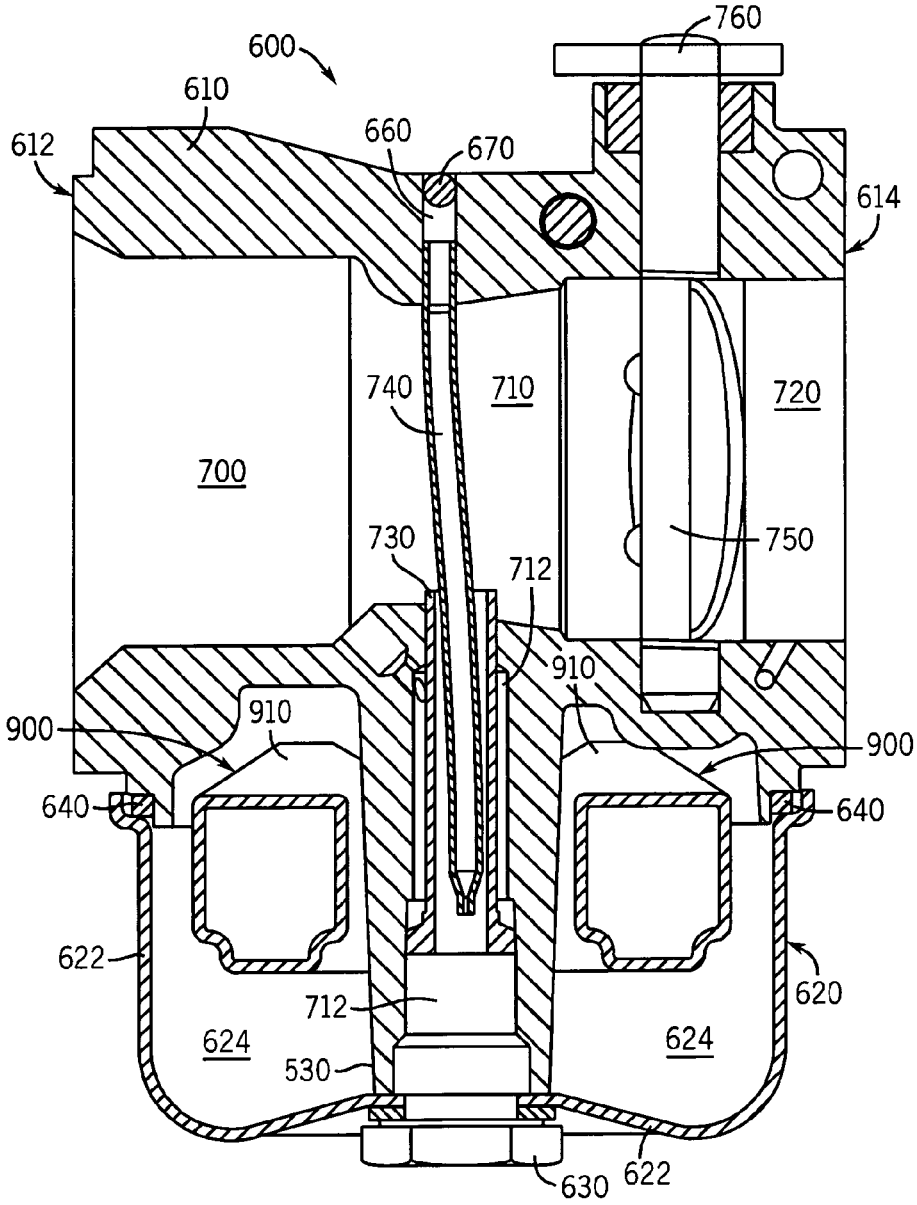
FIG. 12 is a cross sectional view of the carburetor of FIG. 9 taken along line B—B.

Referring specifically to FIGS. 11 and 12, cross sectional views of the carburetor 600 are shown taken along lines A—A and B—B of FIG. 9. The carburetor body 610 has an integral neck 530 that protrudes from the bottom of the body 610 and extends downward therefrom. A fuel bowl 620 is fastened to the neck 530 by a bowl nut 630. The fuel bowl 620 has walls 622 that define an interior volume 624 for containing fuel and extend upward to contact the bottom of the body 610. A gasket 640 is located between the lower portion of the body 610 and the fuel bowl 620 to prevent the leakage of fuel between the fuel bowl 620 and the body 610.

Referring specifically to FIG. 11, a cylindrical bore 650 is formed in one side of the carburetor body 610 and has a proximal end at the outer surface of the body 610 and extends generally horizontally into the body 610. The bore 650 transitions approximately 90 degrees in direction between the proximal end and the distal end such that the distal end of the bore 650 extends generally vertically into the body 610 from the bottom portion of the body 610 such that the distal end communicates with the fuel bowl interior volume 624.

An inlet adapter 780 is received within the proximal end of the bore 650 and is secured by means of a press fit. The inlet adapter 780 interconnects the carburetor 600 and a fuel tank (not shown) and allows the flow of fuel from the fuel tank into the proximal end of the bore 650 through gravity feed or a fuel pump.

A fuel control valve is disposed within the bore 650 and includes an inlet seat 790 and pin 840. The inlet seat 790 is received within the distal end of the bore 650 and is secured by means of a press fit. The inlet seat 790 has an integrally formed side wall 800 and top wall 820. The side wall 800 is generally cylindrical and defines an interior passage 810. The top wall 820 is integrally formed at one end of and perpendicular to the side wall 800 and includes a bore 830 therethrough which allows the flow of fuel from the bore 650 through the passage 810 through the inlet seat 790.

The pin 840 is received within the inlet seat 790 and has an integrally formed tip 870, body 880, and end 890. The body 880 is received within the inlet seat passage 810 and is shaped such that fuel can flow through the passage 810 around the body 880. The tip 870 extends from the body 880 upward toward the valve seat top wall 820 and is tapered such that the tip 870 seats against the bore 830 in the top wall 820 to prevent the flow of fuel through the bore 830 when the pin 840 is in its uppermost position, as shown in FIG. 11. The end 890 extends from the body 880 opposite the tip 870, protrudes outside of the inlet seat 790, and is coupled to a float 900, which is discussed in more detail below, such that the position of the pin 840 is controlled by the movement of the float 900.

The float 900 is disposed within the fuel bowl interior volume 624 and is rotatably fastened to a pair of support arms 920 (only one shown), which are integral to the carburetor body 610 and extend downward from the bottom of the body 610, by a hinge pin 960. The float 900 has a hollow body 910 that extends around the carburetor body neck 530 (see FIG. 12) and floats upon the fuel in the fuel bowl 620 such that the float is raised when the amount of fuel in the fuel bowl 620 increases and is lowered when the amount of fuel in the fuel bowl 620 decreases. The float 900 also has an arm 930, integrally formed with the body 910, that has a lower protrusion 950 and a pair of upper protrusions 940 (only one shown) that couple to the pin end 890 such that the lower and upper protrusions 950, 940 will raise and lower the pin 840 as the arm 930 rotates about the hinge pin 960.

In operation, fuel from the fuel tank flows through the inlet adapter 780 into the bore 650. From the bore 650 the fuel flows through the bore 830 in the top wall 820 of the inlet seat 790 and through the inlet seat passage 810, flowing around the pin 840, to the interior volume 624 of the fuel bowl 620. As the amount of fuel in the fuel bowl 620 increases the float 900 rises. As the float 900 rises the arm 930 is rotated clockwise (as shown in FIG. 11) about the hinge pin 960. This causes the lower protrusion 950 of the float arm 930 to push against the pin end 890, which moves the pin 840 further into the inlet seat 790. When the amount of fuel in the fuel bowl 620 reaches a predetermined level the pin 840 is moved into its uppermost position (as shown in FIG. 11) which seats the pin tip 870 against the inlet seat bore 830, thereby preventing the flow of fuel through the inlet seat 790 into the fuel bowl 620. As the amount of fuel in the fuel bowl 620 decreases the float 900 lowers. As the float 900 lowers the arm 930 is rotated counterclockwise (as shown in FIG. 11) about the hinge pin 960. This causes the upper protrusions 940 of the float arm 930 to pull against the pin end 890, which moves the pin 840 further out of the inlet seat 790 an unseats the pin tip 870 from the inlet seat bore 830, thereby allowing the flow of fuel through the inlet seat 790.

Referring specifically to FIG. 12, an intake bore 700 is formed in the first end 612 of the carburetor body 610 and communicates with the air filter 230. A throttle bore 720 is formed in the second end 614 of the body 610 and communicates with the intake port 200. A venturi 710 is formed in the center of the body 610 between the intake bore 700 and the throttle bore 720 and communicates with both the intake bore 700 and the throttle bore 720 such that air from the intake bore 700 passes into the venturi 710 and from the venturi 710 to the throttle bore 720.

A generally vertical bore 712 is formed in the lower portion of the body 610 and extends from a proximal end at the venturi 710 downward through the neck 530 of the body 610 to a distal end. The proximal end of the bore 712 communicates with the venturi 710 and the distal end of the bore 712 receives the bowl nut 630, which fastens the fuel bowl 620 to the body 610 and closes the distal end of the bore 712. A fuel jet 770 is received within a bore in the neck 530 and allows the flow of fuel from the fuel bowl interior volume 624 to the bore 712. A nozzle 730 is received within the bore 712 and communicates fuel that is received into the bore 712 to the venturi 710 during non-idle operation of the engine. Alternatively, rather than having a separate jet nozzle 730 within the bore 712, the bore 712 could be shaped to perform the function of the nozzle 730 and the nozzle 730 could be removed. An idle tube 740 has a proximal end that is secured within a hole 660 formed at the upper portion of the body 610 and extends downward through the venturi 710 into the nozzle 730 and terminates at a distal end within the nozzle 730. If a nozzle 730 is not used, as described above, the idle tube 740 would extend downward into the bore 712 and terminate at the distal end within the bore 712. The hole 660 is closed above the proximal end of the idle tube 740 by a press fit steel ball 670, or other means for closing the hole. The idle tube transfers fuel from the bore 712 to the throttle bore 720 during idle operation of the engine.

A throttle plate 750 is rotatably mounted within the throttle bore 720 and is connected to a throttle control 760, which controls the orientation of the throttle plate 750. The orientation of the throttle plate 750 controls the amount of fuel/air mixture that passes through the throttle bore 750 into the intake port 200, as is described in more detail below.

In operation, air flows through the air filter 230 into the intake bore 700 and from the intake bore 700 to the venturi 710. In the venturi 710 the pressure of the air is reduced which creates a vacuum within the nozzle 730. The vacuum formed in the nozzle 730 pulls fuel from the fuel bowl 620 through the fuel jet 770 and into the bore 712 in the neck 530 of the carburetor body 610. The fuel in the bore 712 flows through the nozzle 730 and into the venturi 710 where it mixes with the air to produce an air/fuel mixture. The air/fuel mixture from the venturi 710 then flows to the throttle bore 720 and from the throttle bore 720 into the intake port 200. The throttle plate 750 rotates within the throttle bore 720 to control the flow of the fuel/air mixture from the throttle bore 720 to the intake port 200.

Referring again to FIG. 11, a generally horizontal bore 702 is formed in the carburetor body 610 and extends from the intake bore 700 (see FIG. 10) into the body 610, such that the bore 702 communicates with the intake bore 700. A generally vertical bore (not shown) is formed in the body 610 and extends from the horizontal bore 702 through the bottom of the body 610, such that the vertical bore communicates with both the horizontal bore 702 and the fuel bowl internal volume 624. The horizontal bore 702 and the vertical bore define a bowl vent, which interconnects the intake bore 700 and the interior volume 624 to equalize the pressure within the interior volume 624 by exhausting air from the interior volume 624 to the intake bore 700 as the amount of fuel in the interior volume 624 increases and providing air from the intake bore 700 to the interior volume 624 as the amount of fuel in the interior volume 624 decreases.

In addition, a fuel enrichment system is shown that provides the correct fuel enrichment during start-up cranking without operator intervention, thereby avoiding the problems of over or under enrichment. The fuel enrichment system has a passage that has an inlet 680 that communicates with the horizontal bore 702 of the bowl vent and an outlet 690 that communicates with the nozzle 730. Alternatively, the inlet 680 of the passage could also communicate directly with the intake bore 700 or connect to the intake bore 700 in some other manner, as long as air is allowed to pass into the passage from the intake bore 700 and from the intake bore 700 into the passage. In addition, the outlet 690 of the passage could also communicate directly with the bore 712 in the body if a nozzle 730 is not used, as described above, or directly with the venturi 710.

In the preferred embodiment, the passage of the fuel enrichment system is formed by a generally vertical cylindrical bore 370 and a generally horizontal bore 380. The generally vertical cylindrical bore 370 formed in the carburetor body 610 that extends from a proximal end at the inlet 680 of the passage to a distal end at the bottom of the carburetor body 610, such that the vertical bore 370 communicates with the horizontal bore 702 of the bowl vent. The generally horizontal bore 380 is also formed through the side of the carburetor body 610, opposite the bore 650 that receives the inlet adapter 780. The horizontal bore 380 is generally perpendicular to and intersects the vertical bore 370 and extends from a proximal end at the outer surface of the carburetor body 610 to a distal end at the outlet 690 of the passage, such that the distal end of the bore 380 communicates with the nozzle 730 and air from the vertical bore 370 can flow through the horizontal bore 380 and into the nozzle 730. The proximal end of the bore 380 is sealed by a press fit steel ball 390, or other means for sealing the bore 380, to prevent the leakage of air from the horizontal bore 380 to the atmosphere.

A valve seat 460 is received within the distal end of the vertical bore 370 and is secured via a press fit or other securing means. The valve seat 460 is cylindrical and extends from a proximal end, located at the distal end of the bore 370, to a distal end. The proximal end of the valve seat 460 has a diameter approximately equal to the diameter of the bore 370 such that the proximal end of the valve seat 460 will seal the bore 370 and prevent air from the bore 370 from entering the fuel bowl interior volume 624. In the preferred embodiment, the diameter of the valve seat 460 decreases as it approaches the horizontal bore 380 and then increases again past the horizontal bore 380 such that the diameter of the valve seat 460 above the horizontal bore 380 is again approximately equal to the diameter of the vertical bore 370 to prevent air from the bore 370 from entering the horizontal bore 380 around the outside of the valve seat 460. The diameter of the valve seat 460 then decreases again at the distal end.

A passage is formed through the valve seat 460 to allow the flow of air through the valve seat 460 and is formed by a generally vertical bore 470 and a pair of generally horizontal bores 480, 490. The generally vertical bore 470 is formed in the valve seat 460 and extends into the valve seat 460 from the distal end of the valve seat 460. The generally horizontal bore 480 is formed in the valve seat 460 and extends from the vertical bore 470 outward to the outer surface of the valve seat 460 such that the bore 480 communicates with the vertical bore 470 and the horizontal bore 380 in the carburetor body 610. The second generally horizontal bore 490 (shown in FIG. 11 extending into the paper) is also formed in the valve seat 460 perpendicular to the horizontal bore 480 and also extends from the vertical bore 470 outward to the outer surface of the valve seat 460. The two perpendicular horizontal bores 480, 490 are used to ease the insertion of the valve seat 460 into the vertical bore 370 so that alignment is not a concern. With the two perpendicular horizontal bores 480, 490, no matter what the orientation of the valve seat 460 when inserted into the bore 370, one or both of the horizontal bores 480, 490 will be able to communicate with the horizontal bore 380 in the carburetor body 610. Alternatively, if alignment of the valve seat 460 is not a concern, a single horizontal bore 480 in the valve seat 460 could be used. The vertical bore 470 and horizontal bores 480, 490 form the passage through the valve seat 460 that allows air from the vertical bore 370 in the carburetor body 610 to flow to the horizontal bore 380 in the carburetor body 610.

A ball 400 is disposed within the vertical bore 370 at the distal end of the valve seat 460. The diameter of the ball 400 is slightly smaller than the diameter of the vertical bore 370 such that air is allowed to flow around the ball 400. When the ball 400 is at its lowermost position, as shown in FIG. 11, the ball seats against the distal end of the valve seat 460 preventing the flow of air from the bore 370 into the vertical bore 470 in the valve seat 460. As the ball 400 is raised from its lowermost position, as described in more detail below, air is allowed to flow around the ball 400 and into the vertical bore 470 in the valve seat 460.

The mass of the ball 400 should be such that the ball will remain seated against the distal end of the valve seat 460 when the engine is at or below start-up cranking speed (start-up cranking speeds are typically 500 rpm but may vary depending on the engine). In addition, the ball 400 should have a natural frequency such that it will not resonate within the vertical bore 370 and unseat from the distal end of the valve seat 460 due to the vibrations produced by the engine at or below start-up cranking speed. However, the natural frequency of the ball 400 should be such that between engine start-up cranking speed and the maximum speed of the engine, the vibrations produced by the engine will cause the ball 400 to resonate within the bore 370 and unseat from the distal end of the valve seat 460, which will allow air to flow around the ball 400 and into the vertical bore 470 in the valve seat 460.

At normal engine running speeds, the vibrations produced by the engine will cause the ball 400 to resonate with the bore 370 due to the natural frequency of the ball 400. This causes the ball 400 to unseat from the distal end of the valve seat 460, which allows air from the bore 702 to flow through the vertical bore 370, around the ball 400, and into the vertical bore 470 in the valve seat 460. This air then flows through the vertical bore 470 and horizontal bores 480, 490 in the valve seat 460, into the bore 380 in the carburetor body 610, and into the nozzle 730. The air from the nozzle 730 then flows to the venturi 710 where it mixes with the air from the intake bore 700 and the fuel from the nozzle 730, as discussed above. The air from the intake bore 700 and the air that passes through the enrichment system combine to provide the correct fuel/air mixture for proper engine performance and emissions.

Conversely, during engine startup, the weight of the ball 400 and the low rpm of the engine, and therefore low vibration of the engine, keep the ball 400 seated against the distal end of the valve seat 460 thereby preventing air from flowing from the bore 702 through the bores in the valve seat 460 and to the nozzle 730. Therefore, during startup, a portion of the air that would normally flow into the venturi 710 from the enrichment system is removed and only the air from the intake bore 700 flow to the venturi 710. This decreases the amount of air in the fuel/air mixture, which enriches the fuel/air mixture at start-up thereby improving engine starting capability. This system provides the correct fuel enrichment during engine start-up cranking without operator intervention and allows adjustment to prevent over or under enrichment. The fuel enrichment typically would occur up until a time at which the engine reached idle speed (or at least a low idle speed), which would indicate that the engine had successfully been started and cranking of the engine could be ended.

In the present embodiment, the engine 100 is a vertical shaft engine capable of outputting 15–20 horsepower for implementation in a variety of consumer lawn and garden machinery such as lawn mowers. In alternate embodiments, the engine 100 can also be implemented as a horizontal shaft engine, be designed to output greater or lesser amounts of power, and/or be implemented in a variety of other types of machines, e.g., snow-blowers. Further, in alternate embodiments, the particular arrangement of parts within the engine 100 can vary from those shown and discussed above. For example, in one alternate embodiment, the cams 360 could be located above the gears 320 rather than underneath the gears.

While the foregoing specification illustrates and describes the preferred embodiments of this invention, it is to be understood that the invention is not limited to the precise construction herein disclosed. The invention can be embodied in other specific forms without departing from the spirit or essential attributes of the invention. Accordingly, reference should be made to the following claims, rather than to the foregoing specification, as indicating the scope of the invention.

What is claimed is:

1. A carburetor for an internal combustion engine, comprising:

a throat having a bore that extends through it from a first end into which combustion air is drawn to a second end through which an air/fuel mixture exits the throat;

a fuel bowl having walls that define an interior volume;

a jet passageway from the interior volume of the fuel bowl to the bore of the throat to provide a flow of fuel from the interior volume of the fuel bowl to the bore of the throat to mix with the flow of air through the bore;

a fuel enrichment system having a passage formed in a body, said passage has an inlet in communication with the bore of the throat, the fuel enrichment system having an air passageway that supplies a flow of air to the jet passageway at engine speeds above a start-up cranking speed of the engine, the fuel enrichment system being responsive to vibration of the engine at normal engine operating speeds to reduce the flow of air through the air passageway to the jet passageway above the start-up cranking speed of the engine;

the passage in the body being formed by a generally vertical bore, which extends from a proximal end at the inlet of the passage of the fuel enrichment system through the body to a distal end that communicates with the interior volume of the fuel bowl, and a generally horizontal bore, which extends from a proximal end at the generally vertical bore to a distal end at an outlet of the passage of the fuel enrichment system; and a valve seat press fit into the distal end of the generally vertical bore, a passage in the valve seat allows the flow of air from the vertical bore to the horizontal bore.

2. A carburetor for an internal combustion engine, as recited in claim 1, wherein the air passageway of the fuel enrichment device opens in the jet passageway.

3. A carburetor for an internal combustion engine, as recited in claim 1, wherein the fuel enrichment device has an element that opens an air valve to increase the flow or air through the air passageway in response to vibration of the engine at normal engine operating speeds above the start-up cranking speed of the engine.

4. A carburetor for an internal combustion engine, as recited in claim 3, wherein the element is a ball, and the ball vibrates at normal engine operating speeds above the start-up cranking speed of the engine to open the air valve.

5. A carburetor for an internal combustion engine, comprising:

a body having a first end that fastens to an air filter, a second end that fastens to an intake port of a cylinder head, an intake bore formed in the first end, a throttle bore formed in the second end, a venturi formed between the intake bore and the throttle bore that interconnects the intake bore and throttle bore, and a jet passageway extending from the venturi through the body for providing fuel to the venturi;

a fuel bowl, having walls that define an interior volume, fastened to the body;

a fuel enrichment system, responsive to the vibration of the engine, having a passage formed in the body that has an inlet that communicates with the intake bore and an outlet that communicates with the jet passageway, wherein the fuel enrichment system reduces the flow of air through the passage when the engine is at speeds less than idle speed and increases the flow of air through the passage when the engine is at speeds greater than cranking speed, wherein the fuel enrichment system comprises:

a valve seat disposed within the passage in the body, the valve seat having a passage to allow the flow of air through the valve seat;

a ball disposed within the passage in the body, wherein the ball seats against the valve seat blocking the passage in the valve seat when the engine is at speeds less than cranking speed and unseats from the valve seat and vibrates within the passage in the body thereby unblocking the passage in the valve seat and allowing air to flow through the passage in the valve seat when the engine is at speeds greater than cranking speed; and;

the passage in the body is formed by a generally vertical bore, which extends from a proximal end at the inlet of the passage of the fuel enrichment system through the body to a distal end that communicates with the internal volume of the fuel bowl, and a generally horizontal bore, which extends from a proximal end at the generally vertical bore to a distal end at the outlet of the passage of the fuel enrichment system;

the valve seat is press fit into the distal end of the generally vertical bore; and the passage in the valve seat allows the flow of air from the vertical bore to the horizontal bore.

6. A carburetor for an internal combustion engine, as recited in claim 5, comprising a jet nozzle disposed within the jet passageway, wherein the outlet of the passage of the fuel enrichment system communicates with the jet nozzle.

7. A carburetor for an internal combustion engine, as recited in claim 5, comprising a bowl vent, formed in the body, interconnecting the intake bore and the interior volume of the fuel bowl, wherein the inlet of the passage of the fuel enrichment system communicates with the bowl vent.

8. A carburetor for an internal combustion engine, as recited in claim 7, comprising a jet nozzle disposed within the jet passageway, wherein the outlet of the passage of the fuel enrichment system communicates with the jet nozzle.

9. A carburetor for an internal combustion engine, as recited in claim 5, wherein the passage through the valve seat comprises:

a generally vertical bore that communicates with the generally vertical bore of the passage and extends into the valve seat; and a generally horizontal bore that extends from the generally vertical bore in the valve seat to the generally horizontal bore of the passage.

10. A carburetor for an internal combustion engine, as recited in claim 9, wherein the passage through the valve seat further comprises a second generally horizontal bore, perpendicular to the horizontal bore, that extends from the generally vertical bore in the valve seat to the generally horizontal bore of the passage.

11. An internal combustion engine having a carburetor that is fastened between an air filter and an intake port of a cylinder head, the carburetor comprising:

a body having a first end that fastens to the air filter, a second end that fastens to the intake port, an intake bore formed in the first end, a throttle bore formed in the second end, a venturi formed between the intake bore and the throttle bore that interconnects the intake bore and throttle bore, and a jet passageway extending from the venturi through the body for providing fuel to the venturi;

a fuel bowl, having walls that define an interior volume, fastened to the body;

a fuel enrichment system, responsive to the vibration of the engine, having a passage formed in the body that has an inlet that communicates with the intake bore and an outlet that communicates with the jet passageway, wherein the fuel enrichment system reduces the flow of air through the passage when the engine is at speeds less than cranking speed and increases the flow of air through the passage when the engine is at speeds greater than cranking speed, wherein the fuel enrichment system comprises:

a valve seat disposed within the passage in the body, the valve seat having a passage to allow the flow of air through the valve seat;

a ball disposed within the passage in the body, wherein the ball seats against the valve seat blocking the passage in the valve seat when the engine is at speeds less than cranking speed and unseats from the valve seat and vibrates within the passage in the body thereby unblocking the passage in the valve seat and allowing air to flow through the passage in the valve seat when the engine is at speeds greater than cranking speed; and the passage in the body is formed by a generally vertical bore, which extends from a proximal end at the inlet of the passage of the fuel enrichment system through the body to a distal end that communicates with the internal volume of the fuel bowl, and a generally horizontal bore, which extends from a proximal end at the generally vertical bore to a distal end at the outlet of the passage of the fuel enrichment system;

the valve seat is press fit into the distal end of the generally vertical bore; and the passage in the valve seat allows the flow of air from the vertical bore to the horizontal bore.

12. An internal combustion engine, as recited in claim 11, comprising a jet nozzle disposed within the jet passageway, wherein the outlet of the passage of the fuel enrichment system communicates with the jet nozzle.

13. An internal combustion engine, as recited in claim 11, comprising a bowl vent, formed in the body, interconnecting the intake bore and the interior volume of the fuel bowl, wherein the inlet of the passage of the fuel enrichment system communicates with the bowl vent.

14. An internal combustion engine, as recited in claim 13, comprising a jet nozzle disposed within the jet passageway, wherein the outlet of the passage of the fuel enrichment system communicates with the jet nozzle.

15. An internal combustion engine, as recited in claim 11, wherein the passage through the valve seat comprises:

a generally vertical bore that communicates with the generally vertical bore of the passage and extends into the valve seat; and a generally horizontal bore that extends from the generally vertical bore in the valve seat to the generally horizontal bore of the passage.

16. An internal combustion engine, as recited in claim 15, wherein the passage through the valve seat further comprises a second generally horizontal bore, perpendicular to the horizontal bore, that extends from the generally vertical bore in the valve seat to the generally horizontal bore of the passage.

* * * * *